US007433766B2

(12) United States Patent
Ruckser

(10) Patent No.: US 7,433,766 B2
(45) Date of Patent: Oct. 7, 2008

(54) DATA TRANSMISSION SYSTEM, AND METHOD OF TRANSMITTING DATA FROM A CENTRAL STATION TO A TRACK-BOUND VEHICLE

(75) Inventor: Gert Ruckser, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 728 days.

(21) Appl. No.: 10/936,366

(22) Filed: Sep. 8, 2004

(65) Prior Publication Data

US 2005/0060068 A1 Mar. 17, 2005

(30) Foreign Application Priority Data

Sep. 15, 2003 (DE) ..... 103 43 341

(51) Int. Cl.
*B61L 1/00* (2006.01)

(52) U.S. Cl. ..... 701/19; 246/3

(58) Field of Classification Search ..... 701/19, 701/35, 20, 117; 246/3, 4, 14, 62, 72, 122 R, 246/167 R, 176, 177, 182 R, 182 B, 182 C, 246/186

See application file for complete search history.

(56) References Cited

U.S. PATENT DOCUMENTS 4,641,243 A 2/1987 Hartkopf et al.
5,420,883 A * 5/1995 Swensen et al. ..... 375/138
5,533,695 A * 7/1996 Heggestad et al. ..... 246/62
5,950,966 A * 9/1999 Hungate et al. ..... 246/62
6,032,905 A * 3/2000 Haynie ..... 246/3
6,556,898 B2 * 4/2003 Clawson ..... 701/19
7,263,475 B2 * 8/2007 Hawthorne et al. ..... 703/8

FOREIGN PATENT DOCUMENTS

DE 24 02 932 A1 7/1975
DE 43 05 233 A1 8/1994
DE 197 21 246 A1 11/1998
DE 198 32 594 A1 1/2000
EP 0 534 577 B1 12/1995

* cited by examiner

*Primary Examiner*—Dalena Tran
(74) *Attorney, Agent, or Firm*—Henry M. Feiereisen; Ursul B. Day

(57) ABSTRACT

A data transmission system for transmitting data from a central station to a track-bound vehicle traveling on a track includes plural track-side transmitting and receiving devices communicating with an on-vehicle transmitting and receiving device. Each of the track-side transmitting and receiving devices is operatively connected to at least two control computers for communication with the central station. In this way, if the cases arises that the control computer of a pertaining track-side transmitting and receiving device crashes, the communication of this track-side transmitting and receiving device with the central station is maintained through intervention of the other one of the control computers.

12 Claims, 3 Drawing Sheets

DATA TRANSMISSION SYSTEM, AND METHOD OF TRANSMITTING DATA FROM A CENTRAL STATION TO A TRACK-BOUND VEHICLE

CROSS-REFERENCES TO RELATED APPLICATIONS

This application claims the priority of German Patent Application, Serial No. 103 43 341.4, filed Sep. 15, 2003, pursuant to 35 U.S.C. 119(a)-(d), the disclosure of which is incorporated herein by reference.

BACKGROUND OF THE INVENTION

The present invention relates, in general, to the field of data transmission and to a method of transmitting data from a central station to a track-bound vehicle.

Nothing in the following discussion of the state of the art is to be construed as an admission of prior art.

Data between a track-bound vehicle and a central station is transmitted heretofore by so-called intermittent train control (intermittent ATC) or continuous automatic train control (continuous ATC). Intermittent automatic train control involves a transmission of data between the central station and a track-bound vehicle along a track at selected points with limited range. However, no data transmission is possible at locations along the track between individual points.

Continuous ATC provides a data transmission along the entire track between the railway vehicle and the central station. European Pat. No. EP 0 534 577 describes, for example, a continuous ATC, whereby a communication is established via track-side transmitting and receiving devices which are operatively connected with on-vehicle transmitting and receiving devices. Several track-side transmitting and receiving devices are hereby operated by a control computer which is in communication with a central station, for example a signal box or operations control station. In the event, the control computer crashes during operation, any communication between the track-side transmitting and receiving devices and the on-vehicle transmitting and receiving devices is interrupted. Trains that are affected by this breakdown are halted by the safety system, resulting in downtimes and delays. One approach to prevent such delays involves a doubling of all components, i.e. of the track-side transmitting and receiving devices as well as the associated control computers, so that a breakdown of one component can be compensated by the availability of the backup component.

It would be desirable and advantageous to provide an improved data transmission system to obviate prior art shortcomings and to maintain operation in a simple and yet reliable manner, even when a control computer crashes.

SUMMARY OF THE INVENTION

According to one aspect of the present invention, a data transmission system for transmitting data from a central station to a track-bound vehicle traveling on a track includes plural track-side transmitting and receiving devices communicating with an on-vehicle transmitting and receiving device, with each of the track-side transmitting and receiving devices operatively connected to at least two control computers for communication with the central station.

The present invention resolves prior art problems by operatively connecting two control computers with the track-side transmitting and receiving devices. As a consequence, one control computer is thus able to assume the functions of a crashed control computer.

According to another feature of the present invention, the track is subdivided in track sections, with each track section including a one of the control computers and a first plurality of the track-side transmitting and receiving devices, wherein the first plurality of the track-side transmitting and receiving devices is operatively connected to a one of the control computers associated to a neighboring one of the track sections. In this way, the operation of a crashed control computer in one track section can be assumed by a control computer of a neighboring track section, without significantly increasing costs and wiring.

According to another feature of the present invention, each track section has a bus for establishing a communication in the track section between the track-side transmitting and receiving devices and the one control computer, wherein the track-side transmitting and receiving devices have an interface to the bus, and wherein each of the control computers has a first interface to the bus of the associated track section and a second interface to the bus of a neighboring one of the track sections. Thus, each control computer is interfaced with two buses, with one bus connected to the track-side transmitting and receiving devices of the respective track section, and the other bus connected to the track-side transmitting and receiving devices of a neighboring track section. Suitably, each of the control computers has a third interface to the bus of the other neighboring track section, thereby enhancing the fail-safe operation of the data transmission system according to the present invention.

According to another feature of the present invention, each track section may have a bus for establishing a communication in the track section between the track-side transmitting and receiving devices and the associated control computer, wherein the control computers have each an interface to the bus of the associated track section, and wherein the track-side transmitting and receiving devices have a first interface to the bus of the associated track section and a second interface to the bus of a neighboring one of the track sections. In this configuration, each control computer has thus only one interface to a bus, whereas the track-side transmitting and receiving devices have two interfaces.

According to another aspect of the present invention, a method for transmitting data from a central station to a track-bound vehicle traveling on a track includes the steps of disposing along the track of the track-bound vehicle a plurality of track-side transmitting and receiving devices for communication with an on-vehicle transmitting and receiving device, operatively connecting at least two control computers to a central station, and connecting the track-side transmitting and receiving devices to the at least two control computers so that at a crash of one of the control computers communication of the pertaining track-side transmitting and receiving devices with the central station is maintained through intervention of the other one of the control computers.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
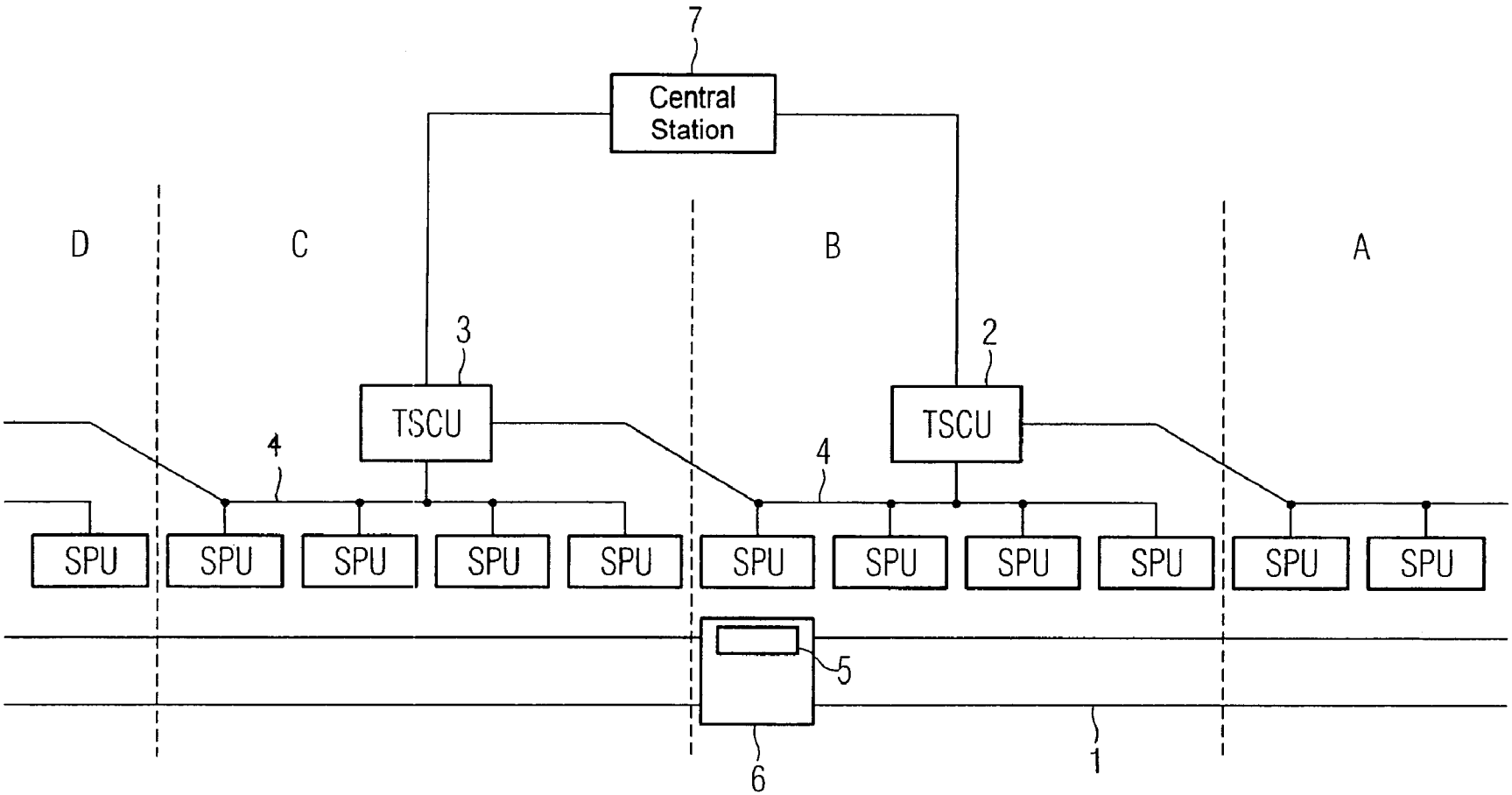
FIG. 1 is a schematic circuit diagram of one embodiment of a data transmission system according to the present invention.

Throughout all the Figures, same or corresponding equipments are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic circuit diagram of one embodiment of a data transmission system according to the present invention, illustrating in particular a connection between control computers TSCU with a track-side control equipment in the form of a plurality of transmitting and receiving devices SPU. Reference numeral 1 designate an exemplified track which is subdivided in track sections A, B, C, D. Track section B is hereby provided with a first control computer 2, whereas the track section C includes a further control computer 3. A bus 4 connects the control computer 2 with the track-side transmitting and receiving devices SPU along the track section B. The track-side transmitting and receiving devices SPU communicate hereby with a on-vehicle control equipment in the form of a transmitting and receiving device 5 which, for example, may be arranged on a vehicle or train 6 which is located in track section B. Thus, commands from a central station 7, such as a signal box or operations control station, can be transmitted via the control computers 2, 3 and the track-side transmitting and receiving devices SPU to the track-bound vehicle 6. Transmitted data or commands may involve, for example, schedule adjustments or direct brake commands as well as positions of the vehicle 6 communicated to the central station 7.

Further connected with the bus 4 of the track-side transmitting and receiving devices SPU in the track section B is the other control computer 3 which is also operatively connected to the central station 7. In this way, the control computer 3 is able to operate the track-side transmitting and receiving devices SPU in the track section B, in the event the control computer 2 crashes.

The control computer 3 is further interfaced with a bus 4 for operating the track-side transmitting and receiving devices SPU in the track section C.

By applying the illustrated circuit diagram and configuration along the entire track 1, each one of the control computers 2, 3 is thus interfaced with a bus 4 in the pertaining one of the track sections A, B, C, D as well as to the bus 4 in a neighboring one of the track sections A, B, C, D.

Figure 2:
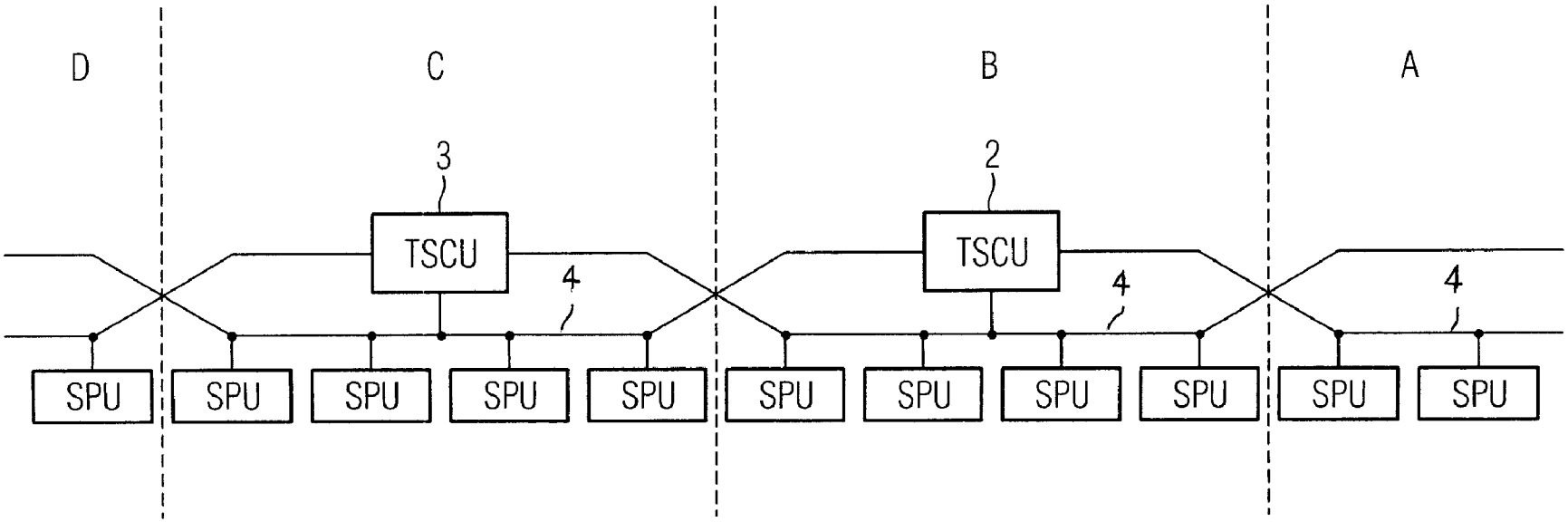
FIG. 2 is a schematic circuit diagram of another embodiment of a data transmission system according to the present invention.

FIG. 2 shows a schematic circuit diagram of another embodiment of a data transmission system according to the present invention. Parts corresponding with those in FIG. 1 are denoted by identical reference numerals and not explained again. The description below will center on the differences between the embodiments. In this embodiment, provision is made for three interfaces for each of the control computers 2, 3. Accordingly, each of the control computers 2, 3 is interfaced with a bus 4 in the respectively pertaining track section as well with the bus 4 of the neighboring downstream track section and the bus 4 of the neighboring upstream track section. In this way, a control computer in one of the track sections A, B, C, D can be substituted by two additional control computers, so that a breakdown or crash of a control computer can now be compensated by either one of the neighboring control computers. Overall, operation of the automatic train control system is hereby even further enhanced.

Figure 3:
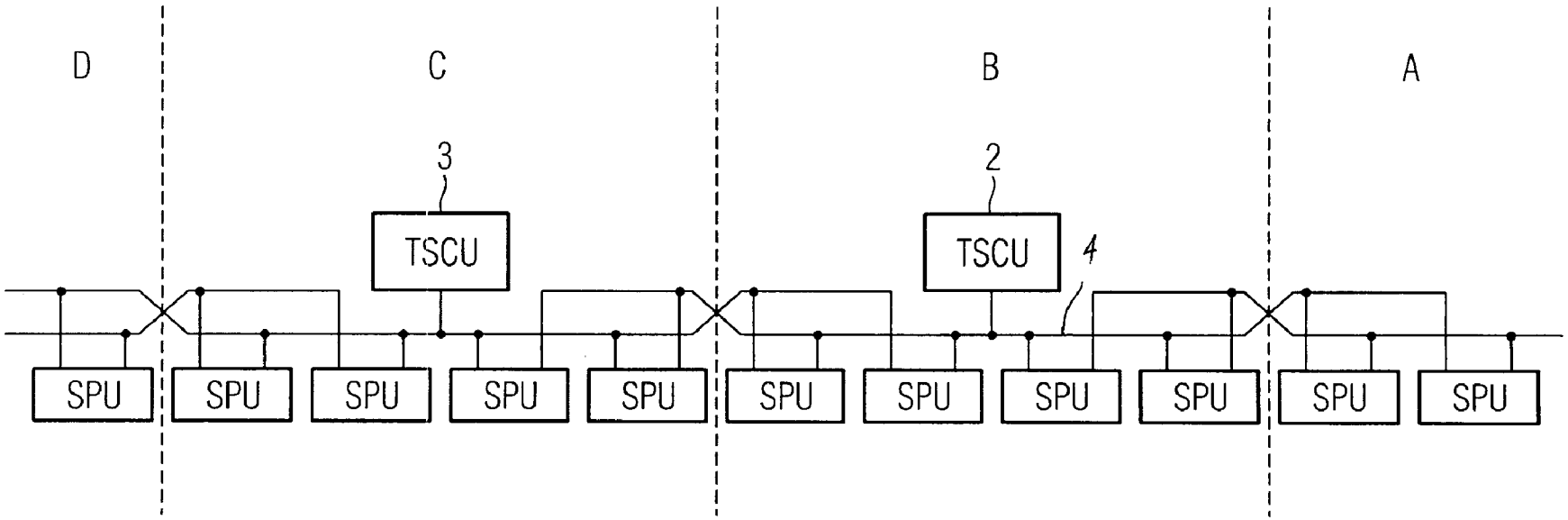
FIG. 3 is a schematic circuit diagram of yet another embodiment of a data transmission system according to the present invention.

FIG. 3 shows a schematic circuit diagram of yet another embodiment of a data transmission system according to the present invention. Parts corresponding with those in FIG. 1 are denoted by identical reference numerals and not explained again. The description below will center on the differences between the embodiments. In this embodiment, the control computers 2, 3 are interfaced with only one bus 4 which is operatively connected to the track-side transmitting and receiving devices SPU in the pertaining track section. The bus 4 is however extended beyond this track section. For example, the bus 4 in the track section B is extended into the track section C as well as into the preceding track section A and includes terminals for connection with some of the track-side transmitting and receiving devices SPU disposed there. Each track-side transmitting and receiving device SPU has hereby two interfaces, one interface to the bus 4 which is connected to the control computer of the pertaining track section, and a further interface connected with the bus 4 of a neighboring track section.

In accordance with the present invention, data transmission is maintained reliably even if one of the control computers 2, 3 crashes. In this case, a further neighboring control computer can assume the operation of the crashed control computer so that a vehicle 6 on the track 1 can proceed and there is no need to temporarily stop the vehicle 6.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the equipments recited therein:

1. A data transmission system for transmitting data from a central station to a track-bound vehicle traveling on a track, comprising plural track-side transmitting and receiving devices communicating with an on-vehicle transmitting and receiving equipment, each of the track-side transmitting and receiving devices operatively connected to at least two control computers for communication with the central station, wherein the control computers are so configured that at a crash of one of the control computers communication of the pertaining track-side transmitting and receiving devices with the central station is maintained through intervention of the other one of the control computers.

2. The data transmission system of claim 1, wherein the track is subdivided in track sections, each track section including a one of the control computers and a first plurality of the track-side transmitting and receiving devices, said first plurality of the track-side transmitting and receiving devices being operatively connected to a one of the control computers associated to a neighboring one of the track sections.

3. The data transmission system of claim 2, wherein each track section has a bus for establishing a communication in the track section between the track-side transmitting and receiving devices and the one control computer, wherein the track-side transmitting and receiving devices has an interface to the bus, and wherein each of the control computers has a first interface to the bus of the associated track section and a second interface to the bus of a neighboring one of the track sections.

4. The data transmission system of claim 3, wherein each of the control computers has a third interface to the bus of another one of the neighboring track sections.

5. The data transmission system of claim 2, wherein each track section has a bus for establishing a communication in the track section between the track-side transmitting and receiving devices and the associated control computer, wherein the control computers have each an interface to the bus of the associated track section, and wherein the track-side transmitting and receiving devices have a first interface to the bus of the associated track section and a second interface to the bus of a neighboring one of the track sections.

6. A method for transmitting data from a central station to a track-bound vehicle traveling on a track, comprising the steps of:

disposing along the track of the track-bound vehicle a plurality of track-side transmitting and receiving devices for communication with an on-vehicle transmitting and receiving device;

operatively connecting at least two control computers to a central station; and connecting each of the track-side transmitting and receiving devices to the at least two control computers so that at a breakdown of one of the control computers communication of the pertaining track-side transmitting and receiving devices with the central station is maintained through intervention of the other one of the control computers.

7. A data transmission system for transmitting data from a central station to a track-bound vehicle traveling on a track, comprising a track-side control equipment communicating with an on-vehicle control equipment and operatively connected to at least two control computers for communication with the central station, wherein the control computers are so configured that at a crash of one of the control computers communication of the track-side control equipment with the central station is maintained through intervention of the other one of the control computers.

8. The data transmission system of claim 7, wherein the track-side control equipment includes a plurality of transmitting and receiving devices.

9. The data transmission system of claim 7, wherein the track is subdivided in track sections, each track section including a one of the control computers and a track-side control equipment, said other one of the control computers being associated to a neighboring track section.

10. The data transmission system of claim 9, wherein the track section is interfaced with a bus for establishing a communication between the track-side control equipment and the one control computer, and wherein the one control computer has a first interface to the bus of the track section and a second interface to a bus of a neighboring track section.

11. The data transmission system of claim 10, wherein the one control computer has a third interface to a bus of another neighboring track section.

12. The data transmission system of claim 9, wherein the track section has a bus, said one control computer interfaced with said bus, and with the track-side control equipment having a first interface to said bus and a second interface to a bus of a neighboring track section.

* * * * *